US006721535B2

(12) United States Patent
Hatano

(10) Patent No.: US 6,721,535 B2
(45) Date of Patent: Apr. 13, 2004

(54) IMAGE FORMING APPARATUS AND METHOD FOR SETTING THE CONVEYING SPEED FOR PAPER SHEETS

(75) Inventor: Mitsuru Hatano, Yokohama (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 39 days.

(21) Appl. No.: 10/213,062

(22) Filed: Aug. 7, 2002

(65) Prior Publication Data

US 2004/0028439 A1 Feb. 12, 2004

(51) Int. Cl.[7] ..... G03G 15/00; B65H 3/44
(52) U.S. Cl. ..... 399/396; 271/9.01; 399/388
(58) Field of Search ..... 399/388, 396; 271/9.01

(56) References Cited

U.S. PATENT DOCUMENTS 5,905,934 A * 5/1999 Koshimizu ..... 399/396
6,148,172 A * 11/2000 Kanda et al. ..... 399/396
6,208,831 B1 * 3/2001 Amano ..... 399/396
6,334,044 B1 * 12/2001 Wasai et al. ..... 399/388
6,397,035 B2 * 5/2002 Kataoka et al. ..... 399/388
6,526,254 B2 * 2/2003 Futagawa ..... 399/396
6,608,991 B2 * 8/2003 Takada ..... 399/396

FOREIGN PATENT DOCUMENTS

JP 09-327949 * 12/1997 ..... G03G/15/00
JP 2000-358120 12/2000

* cited by examiner

*Primary Examiner*—Fred L. Braun
(74) *Attorney, Agent, or Firm*—Foley & Lardner

(57) ABSTRACT

An image forming apparatus has a main unit including a printing section for executing printing on a paper sheet and a first conveyance section for conveying a paper sheet at a set speed, and a peripheral unit connected to the main unit and having a second conveyance section for conveying a paper sheet at a predetermined speed. The apparatus includes a storage for storing the conveyance speed of the second conveyance section, and the upper limit of the current used to drive a motor in the second conveyance section, the conveyance speed and the upper limit being varied in accordance with the type of main unit and stored in association with the upper limit, a type setting section for setting the type of main unit, and a setting section for setting, in accordance with the set type, the conveyance speed of the second conveyance section and the upper limit of the current used to drive the motor.

8 Claims, 4 Drawing Sheets

| Type | Main unit conveyance speed (mm/sec) | Switch state | DA converter output value (V) |
|---|---|---|---|
| Type A | 90 | H | 2.0 |
| Type B | 120 | L | 3.0 |

| Type | Peripheral unit conveyance speed (mm/sec) | Upper current limit (A) |
|---|---|---|
| Type A | 200 | 2.0 |
| Type B | 267 | 3.0 |

IMAGE FORMING APPARATUS AND METHOD FOR SETTING THE CONVEYING SPEED FOR PAPER SHEETS

BACKGROUND OF THE INVENTION

1. Field of the Invention

The present invention relates to an image forming apparatus connectable to a peripheral unit provided with a paper conveyance section, and an operation method for use in the image forming apparatus.

2. Description of the Related Art

In recent image forming apparatuses such as digital copy machines, peripheral units, such as a paper feed unit of a large capacity, a paper discharge unit for distributing discharged paper sheets, etc., are provided as optional units that can be mounted optionally. On the other hand, digital copy machine main units are classified into different types that have the same structure and different copying speeds (e.g. 55, 65, 80 sheets/min.).

Therefore, when a peripheral unit, such as a paper feed unit or discharge unit having a paper conveyance function, is connected to digital copy machine main units of different copying speeds, it is necessary to adjust the speed of a driving system, incorporated in the peripheral unit, in accordance with the conveyance speed of each main unit.

In other words, it is necessary to prepare a peripheral unit corresponding to the copying speed of each main unit. This may involve errors in management or mounting operations. Further, if a plurality of peripheral units are modified as they are common, to avoid such a matter, so that they can be connected to any one of the main units, it is necessary to adjust the driving speed of the motor of the peripheral unit, i.e. the paper conveyance speed of the peripheral units, to the highest paper conveyance speed of each main unit. In this case, if the conveyance speed of the main unit to be connected to the peripheral unit is slow, the current for driving, for example, the driving motor of the peripheral unit is too large, whereby the power consumption becomes large and the motor may generate big noise.

A motor driving circuit may be employed in the main unit for optimizing the motor driving current. In this case, however, the main unit must contain the motor driving circuit even when no peripheral unit is connected, which results in an increase in cost.

BRIEF SUMMARY OF THE INVENTION

It is an object of the invention to provide an image forming apparatus, in which even if peripheral units of a single paper conveyance speed are connected to the main unit of the apparatus of a variable paper conveyance speed, the power consumption and motor noise can be reduced, since the conveyance speed of the peripheral units and the upper limit of the current used to drive the motor of the peripheral units are set at the main unit side, and also provide an operation method for use in the apparatus.

According to an aspect of the invention, there is provided an image forming apparatus having a main unit including a printing section which executes printing on a paper sheet, and also having a peripheral unit connected to the main unit. This apparatus comprises: a first conveyance section provided in the main unit and used to convey a paper sheet at a set speed; a second conveyance section provided in the peripheral unit and used to convey a paper sheet at a predetermined speed; a storage which stores setting data on a conveyance speed of the second conveyance section, and an upper limit of a current used to drive a motor in the second conveyance section, the conveyance speed of the second conveyance section and the upper limit being varied in accordance with a type of the main unit, the conveyance speed of the second conveyance section being stored in association with the upper limit; a type setting section which sets the type of the main unit; and a setting section which sets, in accordance with the set type, the conveyance speed of the second conveyance section and the upper limit of the current used to drive the motor in the second conveyance section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment in which the invention is applied to a digital copying machine will be described with reference to the accompanying drawings.

Figure 1:
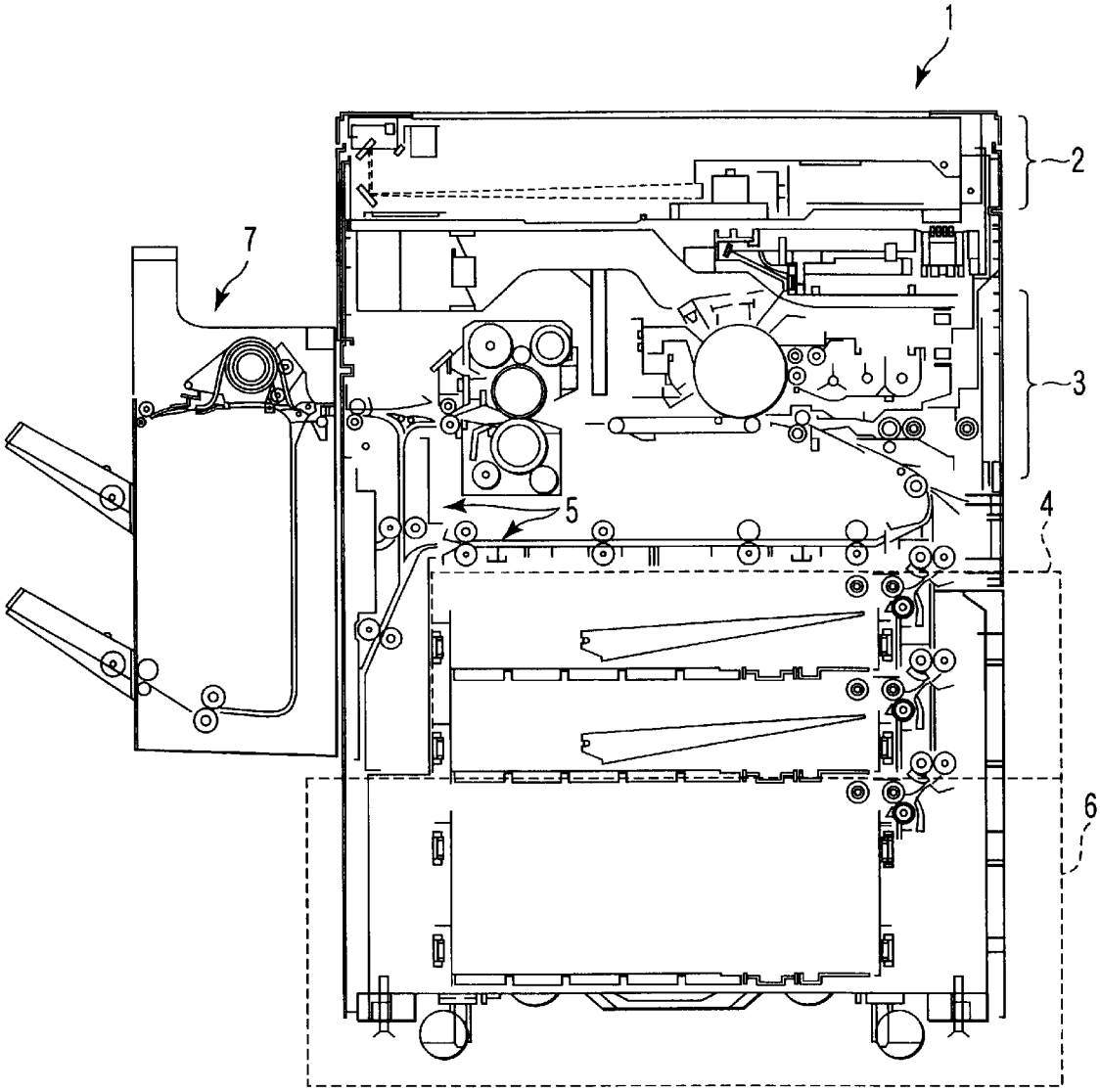
FIG. 1 is a schematic sectional view illustrating an embodiment in which the invention is applied to a digital copying machine.

FIG. 1 is a schematic sectional view of a digital copying machine 1. The main unit of the digital copy machine 1 contains a scanner section 2, printing section 3, first paper feed section 4, automatic double-side printing section 5, etc. Further, a second paper feed section 6 and paper discharge section 7 as peripheral units are mounted on the digital copying machine 1.

Figure 2:
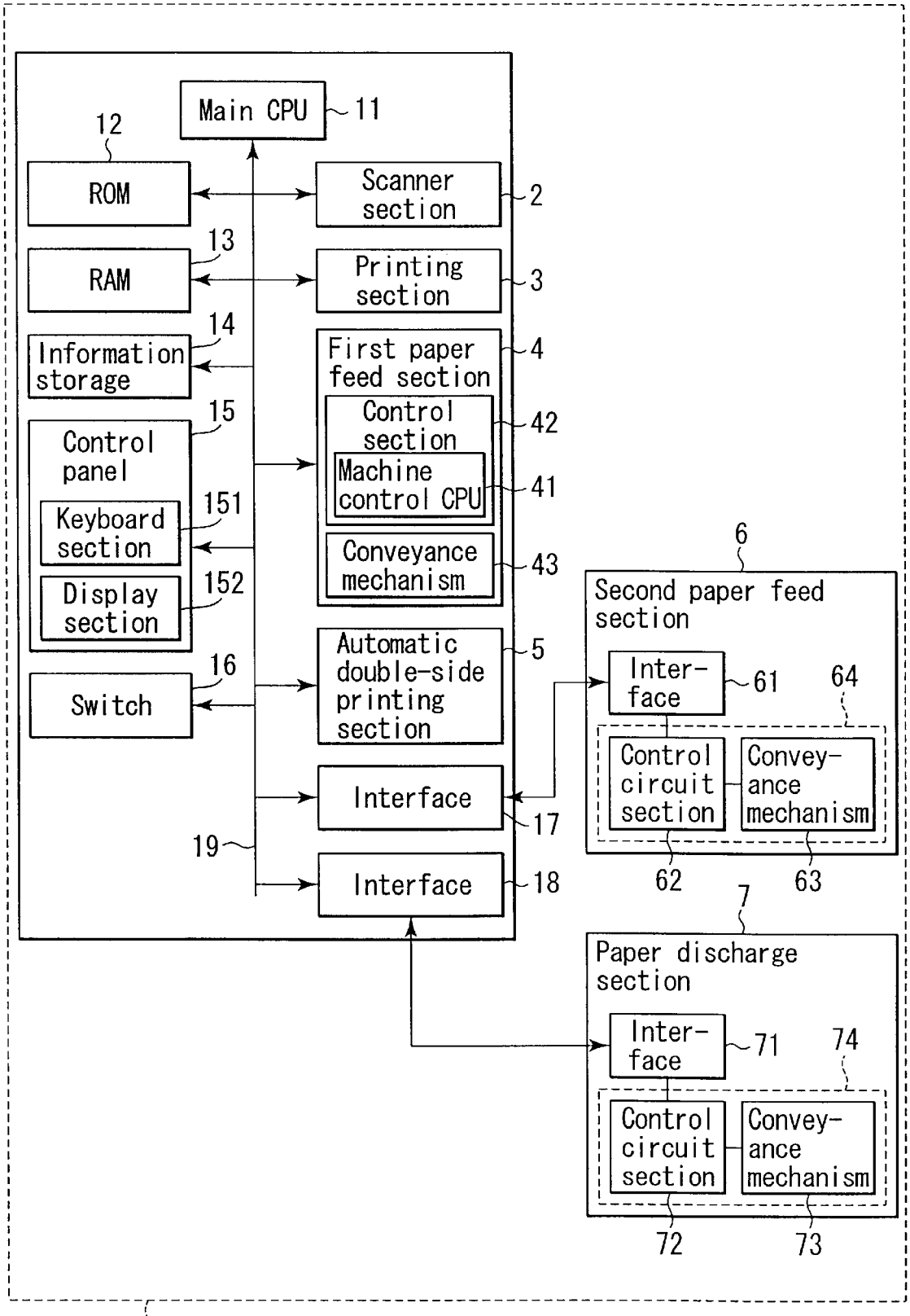
FIG. 2 is a block diagram illustrating the essential configuration of a control system.

FIG. 2 is a block diagram illustrating the essential configuration of a control system. The main unit of the digital copying machine 1 comprises a main CPU 11, ROM 12, RAM 13, information storage 14, control panel 15, switch 16, scanner section 2, printing section 3, first paper feed section 4, automatic double-side printing section 5, interface 17 and interface 18.

The first paper feed section comprises a control section 42 including a machine control CPU 41, and a conveyance mechanism 43 for conveying paper sheets. The control section 42 and conveyance mechanism 43 form a fist conveyance section.

The main CPU 11, ROM 12, RAM 13, information storage 14, control panel 15, switch 16, scanner section 2, printing section 3, first paper feed section 4, automatic double-side printing section 5, and interfaces 17 and 18 are connected to each other by a bus line 19.

The second paper feed section 6 comprises an interface 61, control circuit section 62 and conveyance mechanism 63. The control circuit section 62 and conveyance mechanism 63 form a second conveyance section 64. The interfaces 61 and 17 are connected to each other.

The paper discharge section 7 comprises an interface 71, control circuit section 72 and conveyance mechanism 73. The control circuit section 72 and conveyance mechanism 73 form another second conveyance section for conveying paper sheets. Further, the interfaces 71 and 18 are connected to each other.

The main CPU 11 executes control processing for controlling each section, on the basis of a control program stored in the ROM 12, thereby realizing the operations of the digital copying machine 1.

The ROM 12 stores, for example, the control program for the main CPU 11. The control program stored in the ROM 12 is a generally known program for copy machines.

The RAM 13 is used as, for example, a work area required by the main CPU 11 to execute various types of processing.

The information storage section 14 is formed of a non-volatile memory, and stores setting data on the type of digital copying machine 1, the conveyance speed of the first conveyance section, the conveyance speed of the second conveyance section, and the upper limit of the current for driving the motor, these setting data items being associated with each other.

Figures 3, 4, 5:
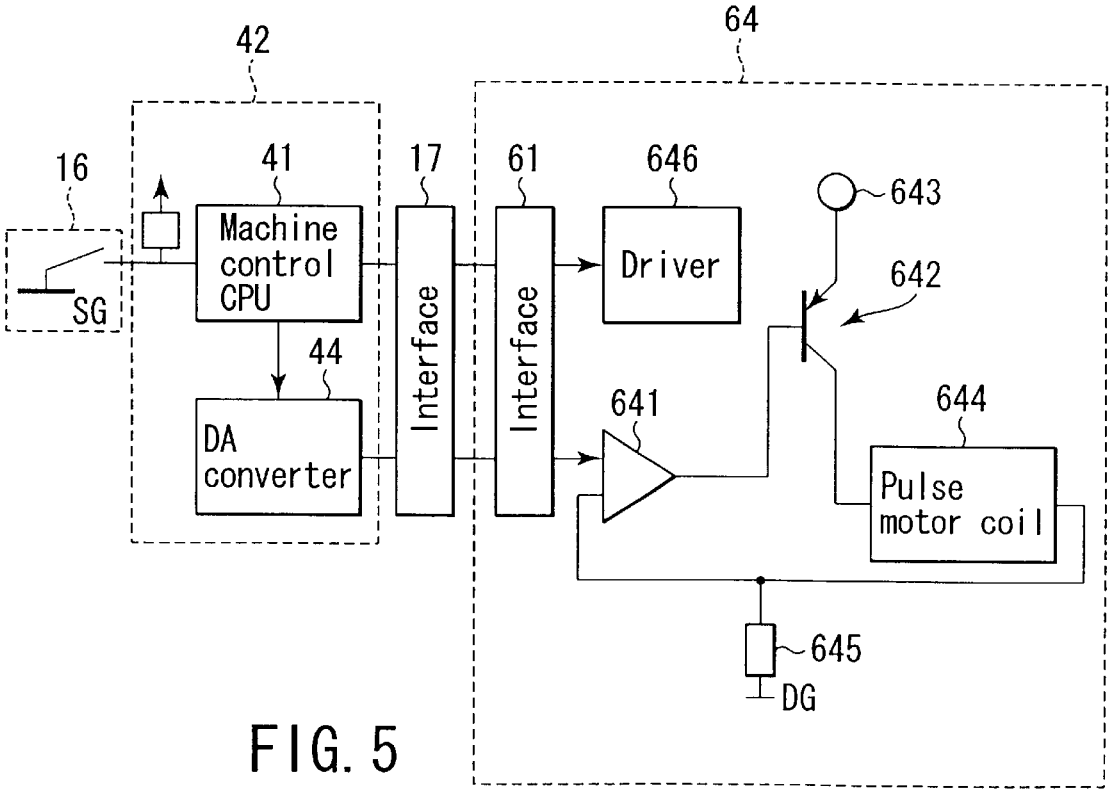
FIG. 3 is a table illustrating set values in a main unit.
FIG. 4 is a table illustrating optimal conveyance speed values and upper current limit values for peripheral units.
FIG. 5 is a view illustrating the configuration of a circuit for setting the upper current limit values.

Specifically, as shown in FIG. 3, if the main unit of the digital copying machine 1 is of type A, data is set such that the paper conveyance speed of the main unit is 90 mm/sec, the status of the switch high (H), and the output value of the DA converter 2.0 V. If the main unit is of type B, data is set such that the paper conveyance speed of the main unit is 120 mm/sec, the status of the switch low (L), and the output value of the DA converter 3.0 V.

The conveyance speed, at which the second paper feed section 6 and discharge section 7 as peripheral units can appropriately convey paper sheets to the type A machine having the aforementioned set values, is 200 mm/sec, and the upper current limit, even at which the driving motor does not generate noise, is 2.0 A, as is shown in FIG. 4. Further, the conveyance speed for the type B machine is 267 mm/sec, and the upper current limit is 3.0 A. Thus, the higher the conveyance speed is set in the main unit, the higher the upper current limit, and the higher the conveyance speed in the second conveyance section within an optimal speed range.

The control panel 15 has a keyboard section 151 formed of, for example, various keys used by the user to input various instructions to the main CPU 11; a display section 152 for displaying various types of information, to be reported to the user, under the control of the main CPU 11; and the like.

The switch 16 is secured to the main unit and used by the user to set the type of the main unit. If the user sets the switch 16 in a state "H", the main unit of the digital copying machine 1 is set as the type A, while if the user sets the switch in a state "L", the main unit is set as the type B.

The scanner section 2 reads an image of a document placed on a document table, and generates image data for the document.

The printing section 3 prints the image data, generated by the scanner section 2, on a paper sheet fed from the first paper feed section 4 or second paper feed section 6, thus executing copying of the document.

In the second paper feed section 6, under the control of the machine control CPU 41, the control circuit section 62 supplies a current to a pulse motor as a driving source to drive the transfer mechanism 63, thereby feeding paper sheets, housed in the paper cassette, to the main unit.

In the paper discharge section 7, under the control of the machine control CPU 41, the control circuit section 72 supplies a current to a pulse motor as a driving source to drive the transfer mechanism 73, thereby discharging paper sheets, fed from the printing section 3, to the discharge tray, or sorting and discharging paper sheets.

Referring now to FIG. 5, a description will be given of the configuration for setting the upper limit of the current supplied to each of the pulse motors of the second paper feed section 6 and paper discharge section 7. Since the second paper feed section 6 and paper discharge section 7 have the same structure for setting the upper current limit, a description will be given only of the second paper feed section 6.

The signal line lead from the machine control CPU 41 is connected to the switch 16, which is connected to a signal ground (SG). The CPU 41 is connected to a DA converter 44.

The signal output from the DA converter 44 is connected to the reference side of a comparator circuit 641. The comparator circuit 641 is connected to the base terminal of a transistor 642. The emitter terminal of the transistor 642 is connected to a power supply 643 of 24 V. Therefore, when a current is supplied from the comparator circuit 641, a current flows from the collector terminal to the coil 644 of the pulse motor. After passing through the coil 644, the current is subjected to current-voltage conversion at a current detecting resistor 645 of 1Ω having one end grounded to a drive ground (DG). The resultant voltage is input to the comparative side of the comparator circuit 641.

The CPU 41 supplies, to a driver 646 in the second paper feed section 6, a signal for determining a pulse rate.

Although FIG. 5 shows only one coil 644 for the pulse motor, the other three coils have the same circuit structure as the above. The pulse motor is driven by controlling the pulse rate of the current flowing through the four coils.

Figure 6:
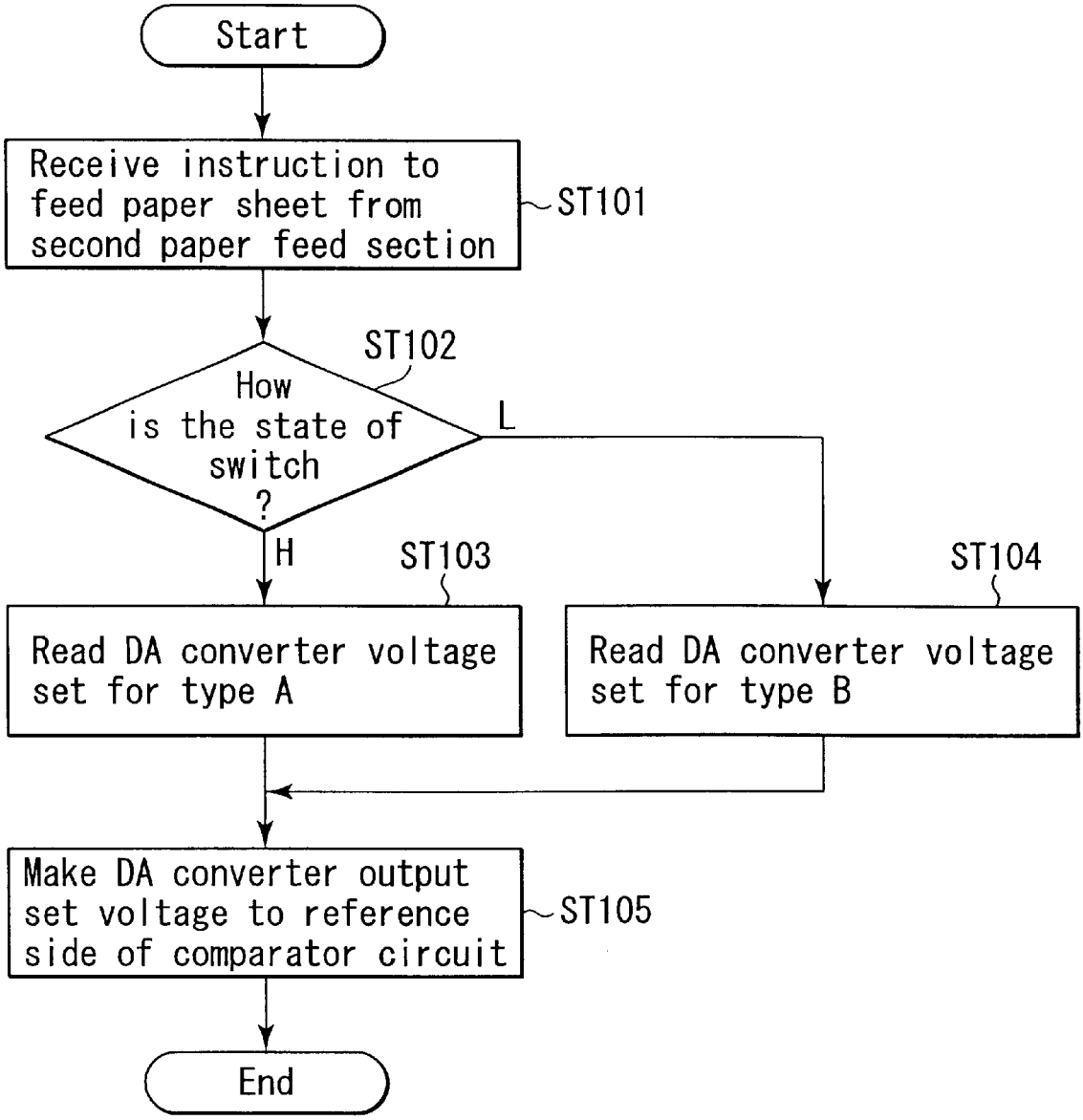
FIG. 6 is a flowchart illustrating the process for setting the upper current limit values.

Referring then to FIG. 6, a description will be given of the process of setting, by the machine control CPU 41 using the above-described configuration, the upper limit of the current used to drive the pulse motor.

At a step ST101, upon receiving an instruction to feed a paper sheet for copying from the second paper feed section, the CPU 41 determines the state of the switch 16 at a step S102.

If it is determined that the switch 16 is in the state "H", i.e., the main unit is of the type A, the CPU 41 reads, at a step S103, a voltage to be output from the DA converter 44, i.e., 2.0 V, set for the type A.

If it is determined that the switch 16 is in the state "L", i.e., the main unit is of the type B, the CPU 41 reads, at a step S104, a voltage to be output from the DA converter 44, i.e., 3.0 V, set for the type B.

At a step ST105, the CPU 41 controls the DA converter 44 so as to supply the set output value to the reference side of the comparator circuit 641.

Therefore, in the second conveyance section 64, if a voltage lower than that set at the reference side of the comparator circuit 641 is applied to the comparative side, a current flows through the transistor 642 and hence the pulse motor is driven. If, on the other hand, a voltage higher than the set voltage is applied, no current flows through the transistor 642, the pulse motor is not driven.

In other words, to pass a current through the transistor 642 to drive the pulse motor, it is necessary to make the voltage, applied to the comparative side of the comparator circuit 641, equal to or lower than the voltage set at the reference side.

When the second paper feed section 6 is attached to the main unit of the type A, the reference side voltage of the comparator circuit 641 is set to 2.0 V. The current flowing in this case is 2.0 A from I=V/R (R=he resistance of the current detecting resistor 645=1Ω). This means that the upper limit of the current flowing through the coils 644 of the pulse motor is 2.0 A.

Further, when the second paper feed section 6 is attached to the main unit of the type B, the reference side voltage of the comparator circuit 641 is set to 3.0 V. The current flowing in this case is 3.0 A from I=V/R (R=the resistance of the current detecting resistor 645=1Ω). This means that the upper limit of the current flowing through the coils 644 of the pulse motor is 3.0 A.

As described above, since the current flowing through the coils 644 of the pulse motor is not greater than 2.0 A in the type A, and not greater than 3.0 A in the type B, the current for driving the motor can be prevented from exceeding a value at which noise is generated from the motor, irrespective of whether the second paper feed section is attached to the type A or B, the main units of the types A and B having different conveyance speeds set.

In other words, even if different paper conveyance speeds are employed in different types of main units, a peripheral unit can be attached to each of them, without changing its structure, by appropriately setting the upper limit of the current flowing through the driving motor in accordance with the type of main unit.

Furthermore, since an excessive current is not supplied to the circuit including the coils 644 of the pulse motor, the power consumption of the second paper feed section 6 and discharge section 7 can be minimized.

In the above-described embodiment, the automatic double-side printing section 5 is incorporated in the digital copying machine 1. However, in the case of a digital copying machine constructed such that the automatic double-side printing section 5 can be attached thereto as a peripheral unit, the invention is also applicable to the automatic double-side printing section 5.

The type of main unit attached to the second paper feed section 6 and discharge section 7 is set by the 1-bit switch 16. If there are three or more types of main units, the switch 16 may be formed of a plurality of switch components so that 2-bit or more setting can be executed. Further, the structure may be employed, in which a plurality of types are stored in the information storage 14, and the type setting is executed using the keyboard section 151. In the case where a plurality of settings are possible, the invention is also used to adjust variations in the digital copying machine by setting a plurality of upper limit values for one type, or by employing a structure in which the upper limit can be finely adjusted.

In addition, the upper current limit is set by the DA converter 44 and 24-V power supply 643. Instead of the DA converter 44, a rudder resistor may be used to change the DA voltage. The current may be set by an analog switch instead of the power supply 643, or the analog switch may be connected to the set current terminal of a circuit element for driving the motor.

Although the driving motor of the digital copying machine is a pulse motor, it may be a circuit for switching the power supply of a DC motor or a DC brushless motor.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus provided with a main unit including a printing section which executes printing on a paper sheet, and also provided with a peripheral unit connected to the main unit, comprising:

a first conveyance section provided in the main unit and used to convey a paper sheet at a set speed;

a second conveyance section provided in the peripheral unit and used to convey a paper sheet at a predetermined speed;

a storage which stores setting data on a conveyance speed of the second conveyance section, and an upper limit of a current used to drive a motor in the second conveyance section, the conveyance speed of the second conveyance section and the upper limit being varied in accordance with a type of the main unit, the conveyance speed of the second conveyance section being stored in association with the upper limit;

a type setting section which sets the type of the main unit; and a setting section which sets, in accordance with the set type, the conveyance speed of the second conveyance section and the upper limit of the current used to drive the motor in the second conveyance section.

2. The image forming apparatus according to claim 1, wherein the setting section sets the upper limit such that the higher the conveyance speed of the first conveyance section, the higher the upper limit.

3. The image forming apparatus according to claim 1, wherein the type setting section is a switch provided in the main unit.

4. The image forming apparatus according to claim 1, wherein the type setting section is a keyboard provided in the main unit.

5. A method of operating an image forming apparatus provided with a main unit including a printing section which executes printing on a paper sheet, and also provided with a peripheral unit connected to the main unit, comprising:

permitting a type of the main unit to be set;

setting a conveyance speed of a first conveyance section provided in the main unit and used to convey a paper sheet;

reading, from a storage in accordance with the set type, setting data on a conveyance speed of a second conveyance section and an upper limit of a current used to drive a motor in the second conveyance section, the conveyance speed of the second conveyance section and the upper limit being varied in accordance with the type of the main unit, the storage storing the conveyance speed of the second conveyance section in association with the upper limit; and setting, on the basis of the read setting data, the conveyance speed of the second conveyance section and the upper limit of the current used to drive the motor in the second conveyance section.

6. The method of operating the image forming apparatus operating according to claim 5, wherein the higher the conveyance speed of the first conveyance section, the higher the upper limit is set.

7. The method of operating the image forming apparatus according to claim 5, wherein setting of the type is permitted through a switch provided in the main unit.

8. The method of operating the image forming apparatus according to claim 5, wherein setting of the type is permitted through a keyboard provided in the main unit.

* * * * *